US012760678B1

(12) United States Patent
Kappel

(10) Patent No.: US 12,760,678 B1
(45) Date of Patent: Oct. 13, 2026

(54) TWO-STAGE COOLING APPARATUS

(71) Applicant: Sandor Kappel, Milford, CT (US)

(72) Inventor: Sandor Kappel, Milford, CT (US)

( * ) Notice: Subject to any disclaimer, the term of this patent is extended or adjusted under 35 U.S.C. 154(b) by 0 days.

(21) Appl. No.: 19/263,090

(22) Filed: Jul. 8, 2025

(51) Int. Cl.
*F01P 3/00* (2006.01)
*F01P 3/20* (2006.01)

(52) U.S. Cl.
CPC ..... *F01P 3/20* (2013.01); *F01P 2003/006* (2013.01); *F01P 2070/52* (2013.01)

(58) Field of Classification Search
CPC .. F01M 5/002; F01M 2011/033; F01M 11/03; F28D 9/0012; F28D 2021/0089; F28D 1/0333
USPC ..... 123/41.42
See application file for complete search history.

(56) References Cited

U.S. PATENT DOCUMENTS 3,743,011 A 7/1973 Frost
4,742,866 A * 5/1988 Yamanaka ..... F16N 39/02 165/283
4,892,136 A * 1/1990 Ichihara ..... F01M 11/03 123/196 AB
5,351,664 A 10/1994 Rotter et al.
5,363,823 A * 11/1994 Gittlein ..... F01M 5/002 123/196 AB
6,085,832 A * 7/2000 Rehberg ..... F28D 9/0012 165/167
6,857,468 B2 * 2/2005 Emrich ..... F28D 9/0012 165/125
8,911,620 B2 * 12/2014 Silegren ..... B01D 35/18 123/196 AB
11,215,321 B2 * 1/2022 Dods ..... F28D 9/0056
11,915,850 B2 * 2/2024 Fovell ..... H01F 27/08
2009/0038580 A1 2/2009 Hamilton
2009/0159249 A1 * 6/2009 Pustelnik ..... F28F 19/01 165/157

OTHER PUBLICATIONS

Big Dog Motorcycle Oil Cooler, retrieved from the internet, retrieved on Jul. 7, 2025; <URL: https://chopperdavesmoto.com/shop/ols/products/big-dog-motorcycle-chromed-oil-cooler-and-adapter>.

* cited by examiner

*Primary Examiner* — Logan M Kraft
*Assistant Examiner* — James J Kim

(57) ABSTRACT

A two-stage cooling apparatus includes an outer member and an inner member. The outer member includes a first end base located and a second end base, a central hole, a plurality of heatsinks, and a plurality of longitudinal. The plurality of heatsinks is circumferentially arranged about the central hole. Each heatsink extends from the first end base to the second end base of the outer member. The heatsink comprises an outer heatsink base comprising an outer fluid channel having an inlet and an outlet, and an outer heat dissipation mechanism associated with the outer fluid channel. The plurality of longitudinal slots is arranged between two adjacent outer heatsinks. The inner member is adapted to be secured into the central hole. The inner member comprises an inner heatsink base comprising an inner fluid channel and an inner heat dissipation mechanism associated with the inner fluid channel.

16 Claims, 16 Drawing Sheets

TWO-STAGE COOLING APPARATUS

FIELD OF THE INVENTION

The present invention relates generally to cooling apparatuses. More specifically, the present invention is a two-stage cooling apparatus. The present invention is specifically designed for internal combustion engines. However, the present invention is not limited to this option, and it may further be adapted for different purposes.

BACKGROUND OF THE INVENTION

An internal combustion engine works by burning fuel and air inside a small, enclosed space called a combustion chamber. This reaction produces hot, high-pressure gases that expand and push against parts of the engine—such as pistons or rotors—to create movement. The key feature of this type of engine is that it uses the force from the expanding gases to do useful work inside the engine itself.

Motor oil is used in internal combustion engines to reduce friction between moving parts. It forms a thin layer between surfaces that slide against each other, which helps prevent direct contact. This reduces wear, lowers friction, and prevents parts from getting too hot. Motor oil also helps carry heat away from the engine parts. Since engine materials can weaken at high temperatures, keeping the engine cool is important for long-term durability. An oil filter is usually included to remove dirt and debris from the oil.

Engines also produce a lot of waste heat because they are not 100% efficient. Some of this heat leaves through the exhaust, but extra cooling is still needed to keep the engine from overheating. Standard cooling systems focus mainly on the engine block and cylinder head, and often do not cool the motor oil well enough. Without proper oil cooling, the engine can overheat and suffer damage over time.

Therefore, it is an objective of the present invention to provide a cooling apparatus that overcomes the problems set forth above.

SUMMARY OF THE INVENTION

The present invention discloses a two-stage cooling apparatus. The apparatus includes an outer member and an inner member. The outer member includes a first end base located and a second end base, a central hole, a plurality of heatsinks, and a plurality of longitudinal. The plurality of heatsinks is circumferentially arranged about the central hole. Each heatsink extends from the first end base to the second end base of the outer member. The heatsink comprises an outer heatsink base comprising an outer fluid channel having an inlet and an outlet, and an outer heat dissipation mechanism associated with the outer fluid channel. The plurality of longitudinal slots is arranged between two adjacent outer heatsinks. The inner member is adapted to be secured into the central hole. The inner member comprises an inner heatsink base comprising an inner fluid channel and an inner heat dissipation mechanism associated with the inner fluid channel.

In one embodiment, the outer member has a cylindrical shape.

In one embodiment, the inlet of the outer fluid channel is adapted to be in fluid communication with an internal combustion engine, and the outlet of the outer fluid channel is adapted to be in fluid communication with an oil filter.

In one embodiment, the inlet of the inner fluid channel is adapted to be in fluid communication with the oil filter, and the outlet of the inner fluid channel is adapted to be in fluid communication with the internal combustion engine.

In one embodiment, the outer heatsink base is located adjacent to the central hole, while the outer heat dissipation mechanism extends outward from the outer heatsink base.

In one embodiment, the outer heat dissipation mechanism comprises a plurality of fins.

In one embodiment, the plurality of fins has an annular sector shape.

In one embodiment, the first end base comprises an outer flange, an inner flange, and a circumferential groove formed by the outer flange and the inner flange.

In one embodiment, the inner member is secured into the central hole via welding.

In one embodiment, the inner member has a cylindrical shape.

In one embodiment, the first end of the inner member comprises a first attachment mechanism.

In one embodiment, the first attachment mechanism comprises internal threads.

In one embodiment, the second end of the inner member comprises a second attachment mechanism.

In one embodiment, the second attachment mechanism comprises external threads.

In one embodiment, the inner heat dissipation mechanism extends outward from the inner heatsink base.

In one embodiment, the inner heat dissipation mechanism comprises a plurality of fins.

BRIEF DESCRIPTION OF THE DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the present invention. That is, the dimensions of the components of the present invention, independently and in relation to each other can be different. It should be noted that the drawings are schematic and not necessarily drawn to scale. Some drawings are enlarged or reduced to improve drawing legibility.

DETAIL DESCRIPTIONS OF THE INVENTION

Figure 1:
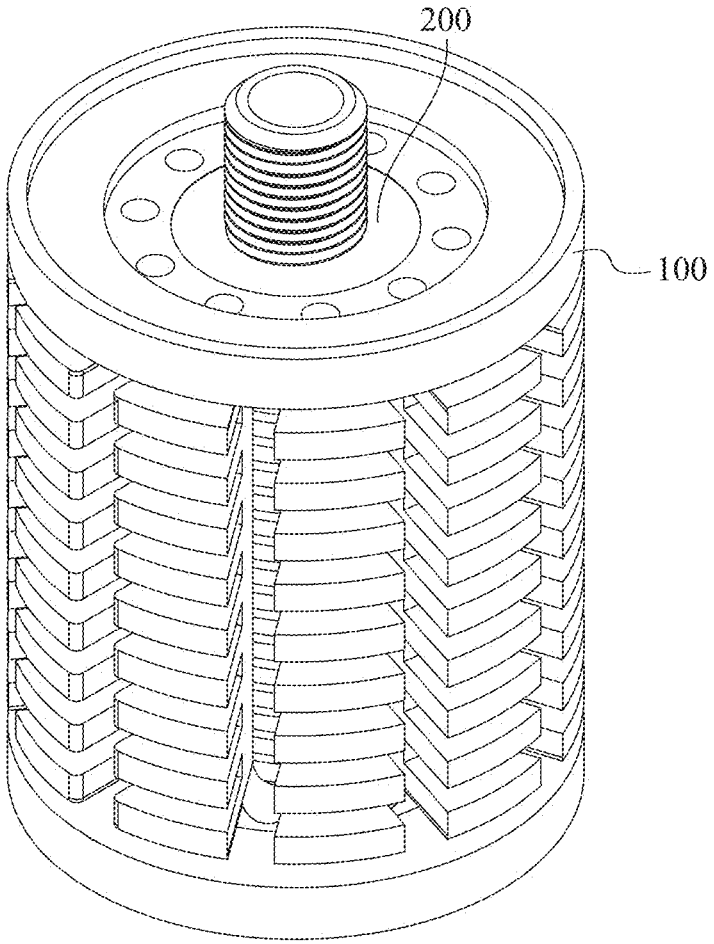
FIG. 1 depicts a perspective view of the present invention.
Figure 2:
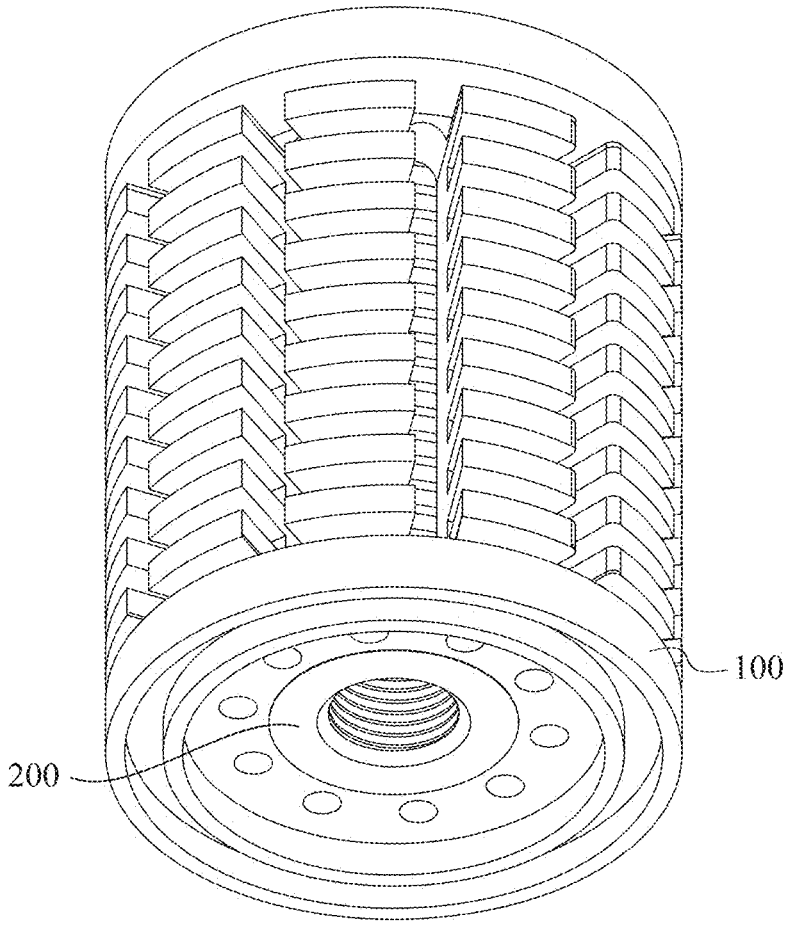
FIG. 2 depicts another perspective view of the present invention.
Figure 3:
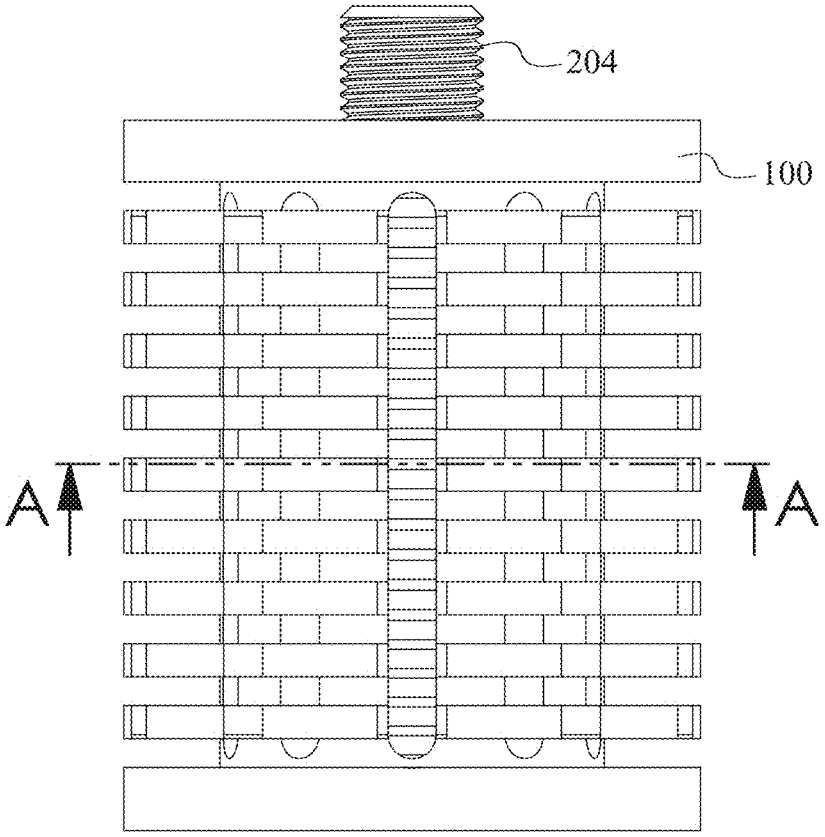
FIG. 3 depicts a front view of the present invention.
Figure 4:
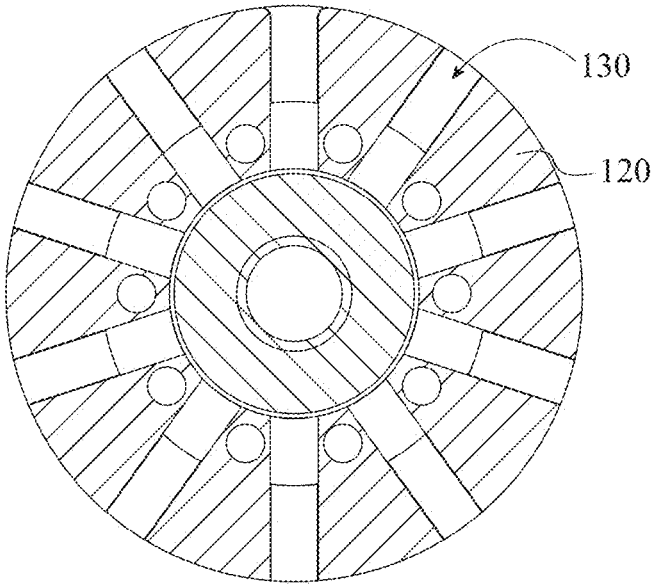
FIG. 4 depicts a cross-sectional view of the present invention, taken along the line A-A in FIG. 3.
Figure 5:
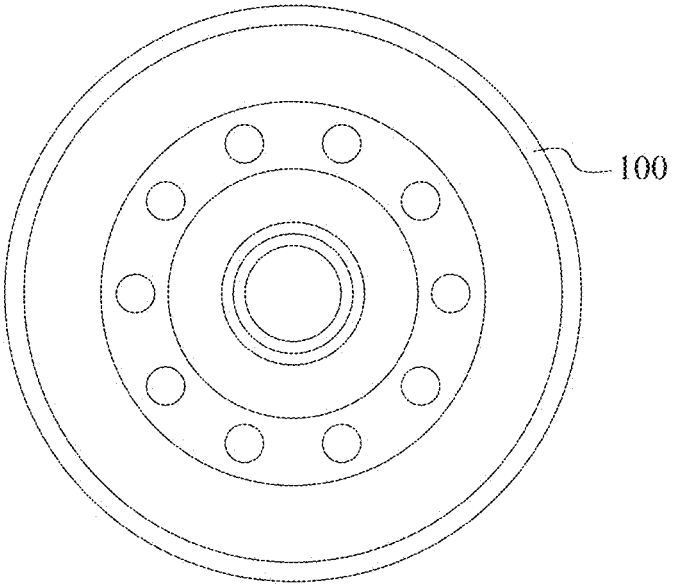
FIG. 5 depicts a top view of the present invention.
Figure 6:
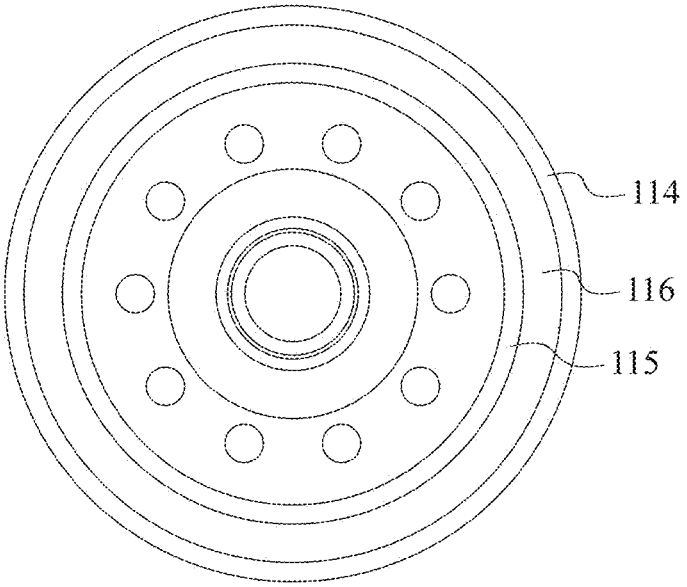
FIG. 6 depicts a bottom view of the present invention.
Figure 7:
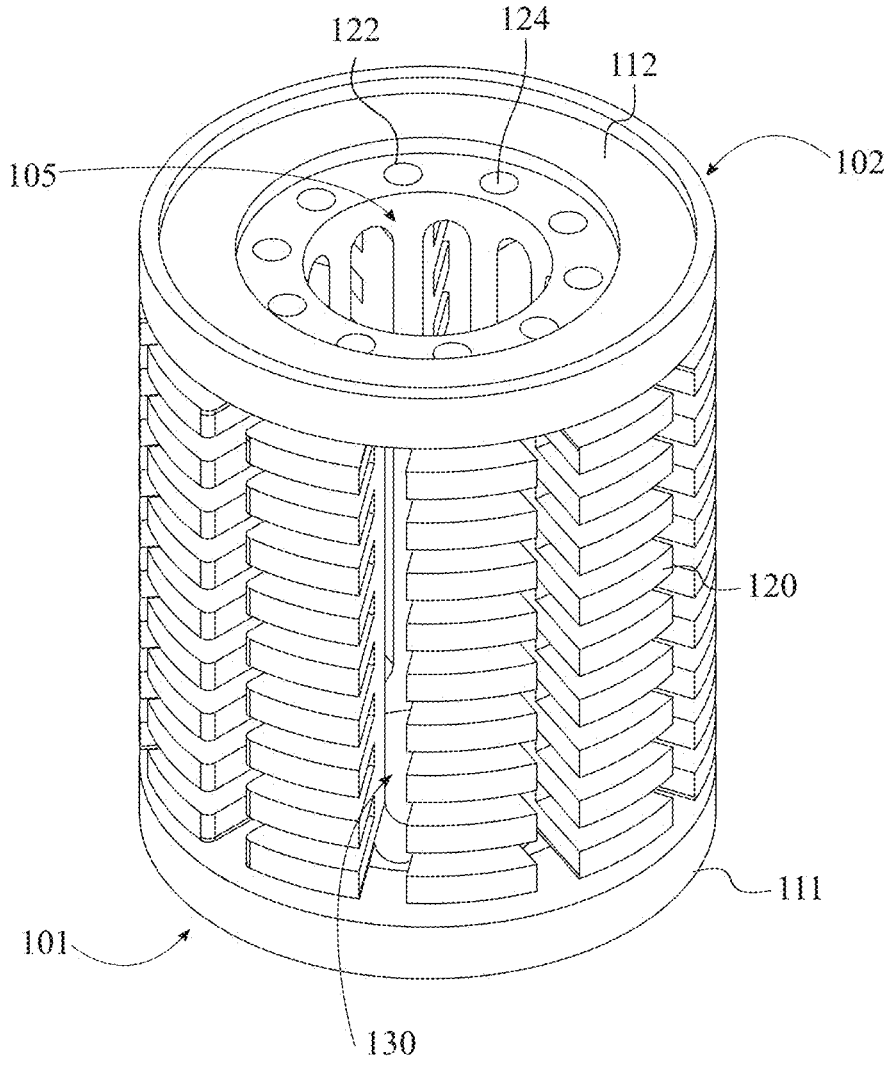
FIG. 7 depicts a perspective view of the outer member of the present invention.
Figure 8:
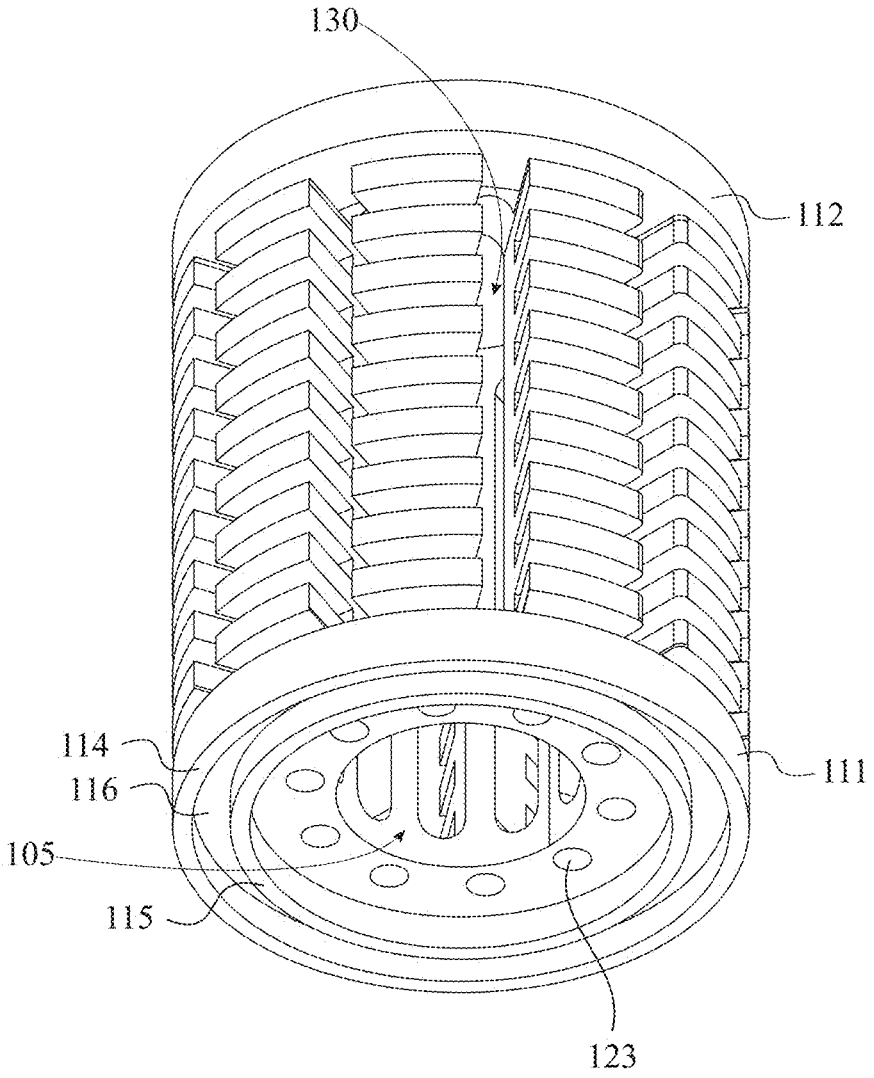
FIG. 8 depicts another perspective view of the outer member of the present invention.
Figure 9:
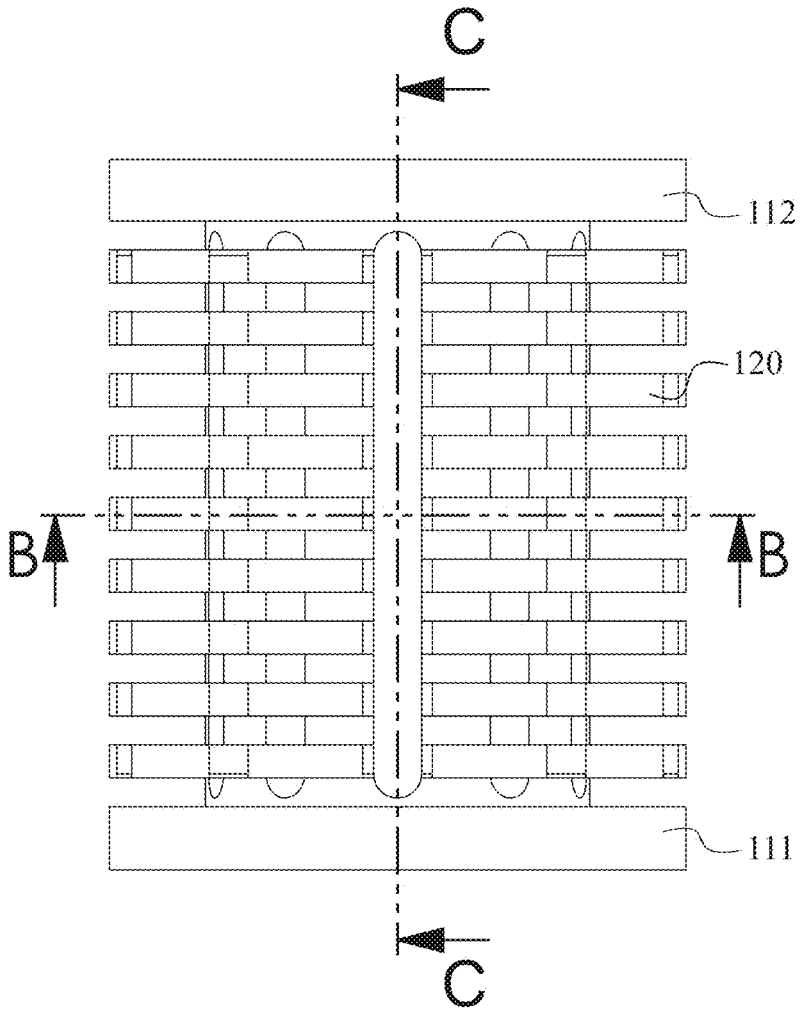
FIG. 9 depicts a front view of the outer member of the present invention.
Figure 10:
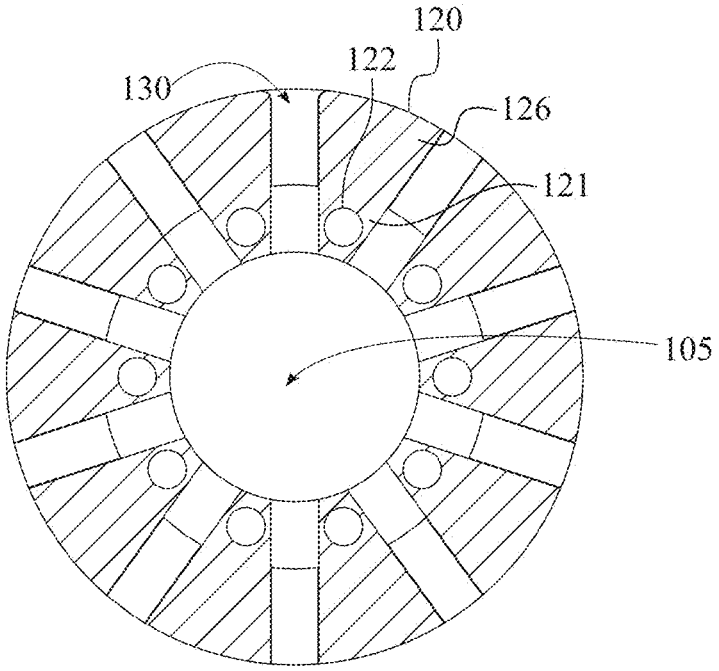
FIG. 10 depicts a cross-sectional view of the present invention, taken along the line B-B in FIG. 9.
Figure 11:
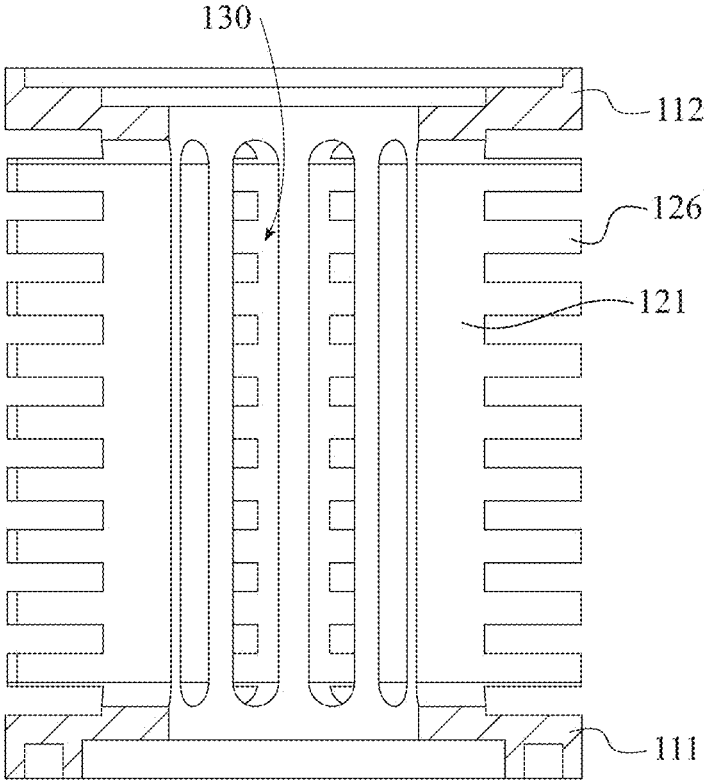
FIG. 11 depicts a cross-sectional view of the present invention, taken along the line C-C in FIG. 9.
Figure 12:
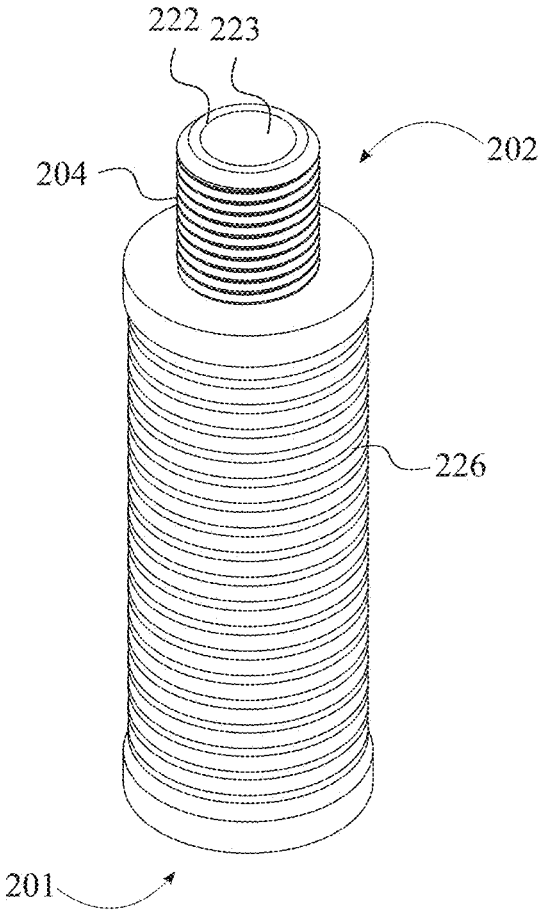
FIG. 12 depicts a perspective view of the inner member of the present invention.
Figure 13:
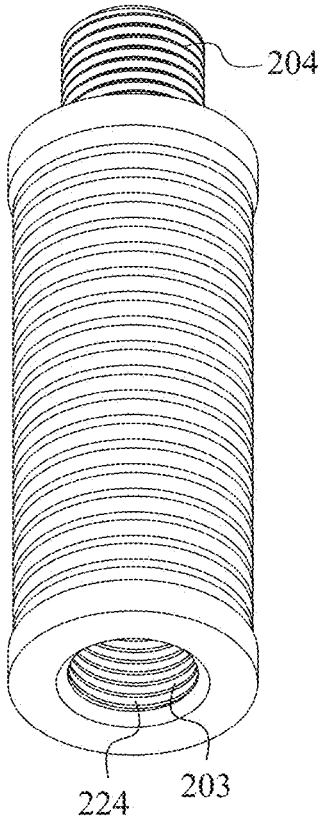
FIG. 13 depicts another perspective view of the inner member of the present invention.
Figure 14:
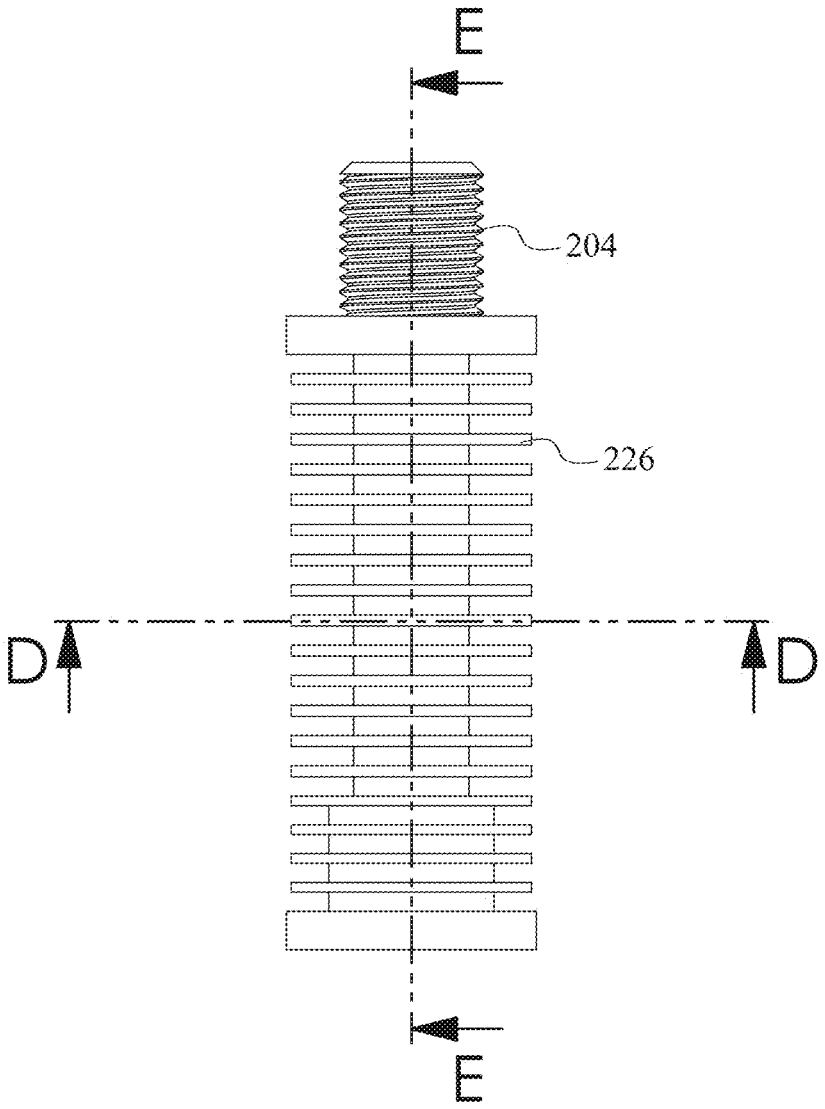
FIG. 14 depicts a front view of the inner member of the present invention.
Figure 15:
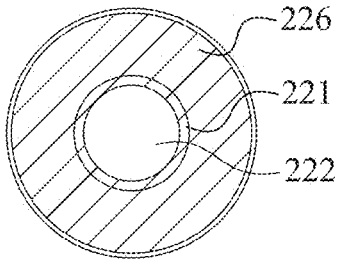
FIG. 15 depicts a cross-sectional view of the present invention, taken along the line D-D in FIG. 14.
Figure 16:
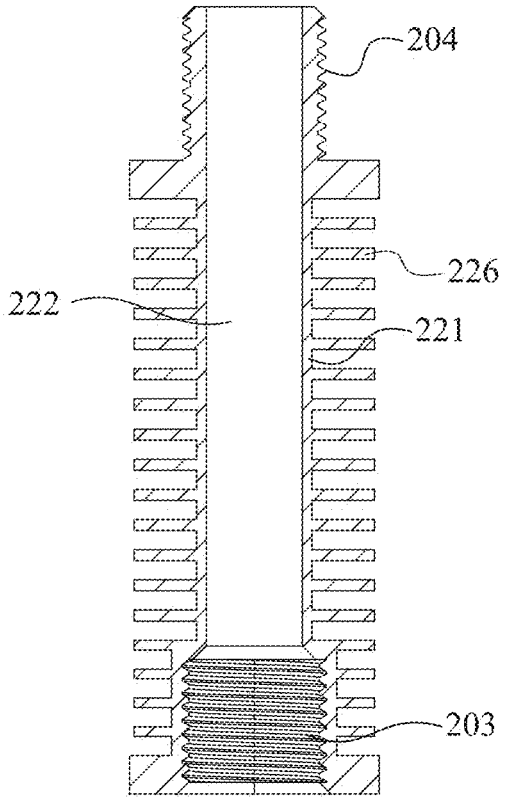
FIG. 16 depicts a cross-sectional view of the present invention, taken along the line E-E in FIG. 14.

As a preliminary matter, it will readily be understood by one having ordinary skill in the relevant art that the present disclosure has broad utility and application. As should be understood, any embodiment may incorporate only one or a plurality of the above-disclosed aspects of the disclosure and may further incorporate only one or a plurality of the above-disclosed features. Furthermore, any embodiment discussed and identified as being "preferred" is considered to be part of a best mode contemplated for carrying out the embodiments of the present disclosure. Other embodiments also may be discussed for additional illustrative purposes in providing a full and enabling disclosure. Moreover, many embodiments, such as adaptations, variations, modifications, and equivalent arrangements, will be implicitly disclosed by the embodiments described herein and fall within the scope of the present disclosure.

Accordingly, while embodiments are described herein in detail in relation to one or more embodiments, it is to be understood that this disclosure is illustrative and exemplary of the present disclosure and is made merely for the purposes of providing a full and enabling disclosure. The detailed disclosure herein of one or more embodiments is not intended, nor is to be construed, to limit the scope of patent protection afforded in any claim of a patent issuing here from, which scope is to be defined by the claims and the equivalents thereof. It is not intended that the scope of patent protection be defined by reading into any claim a limitation found herein that does not explicitly appear in the claim itself. Accordingly, it is intended that the scope of patent protection is to be defined by the issued claim(s) rather than the description set forth herein.

Additionally, it is important to note that each term used herein refers to that which an ordinary artisan would understand such term to mean based on the contextual use of such term herein. When not explicitly defined herein, to the extent that the meaning of a term used herein—as understood by the ordinary artisan based on the contextual use of such term—differs in any way from any particular dictionary definition of such term, it is intended that the meaning of the term as understood by the ordinary artisan should prevail.

Furthermore, it is important to note that, as used herein, "a" and "an" each generally denotes "at least one," but does not exclude a plurality unless the contextual use dictates otherwise. When used herein to join a list of items, "or" denotes "at least one of the items," but does not exclude a plurality of items of the list. Finally, when used herein to join a list of items, "and" denotes "all of the items of the list."

The following detailed description refers to the accompanying drawings. Wherever possible, the same reference numbers are used in the drawings and the following description to refer to the same or similar elements. While many embodiments of the disclosure may be described, modifications, adaptations, and other implementations are possible. For example, substitutions, additions, or modifications may be made to the elements illustrated in the drawings, and the methods described herein may be modified by substituting, reordering, or adding stages to the disclosed methods. Accordingly, the following detailed description does not limit the disclosure. Instead, the proper scope of the disclosure is defined by the appended claims. The present disclosure contains headers. It should be understood that these headers are used as references and are not to be construed as limiting upon the subject matter disclosed under the header.

Other technical advantages may become readily apparent to one of ordinary skill in the art after review of the following figures and description. It should be understood at the outset that, although exemplary embodiments are illustrated in the figures and described below, the principles of the present disclosure may be implemented using any number of techniques, whether currently known or not. The present disclosure should in no way be limited to the exemplary implementations and techniques illustrated in the drawings and described below.

Unless otherwise indicated, the drawings are intended to be read together with the specification and are to be considered a portion of the entire written description of this invention. As used in the following description, the terms "horizontal", "vertical", "left", "right", "up", "down" and the like, as well as adjectival and adverbial derivatives thereof (e.g., "horizontally", "rightwardly", "upwardly", "radially", etc.), simply refer to the orientation of the illustrated structure as the particular drawing figure faces the reader. Similarly, the terms "inwardly," "outwardly" and "radially" generally refer to the orientation of a surface relative to its axis of elongation, or axis of rotation, as appropriate. As used herein, the term "proximate" refers to positions that are situated close/near in relationship to a structure. As used in the following description, the term "distal" refers to positions that are situated away from positions.

The present disclosure includes many aspects and features. Moreover, while many aspects and features relate to, and are described in the context of cooling apparatuses, embodiments of the present disclosure are not limited to use only in this context.

The present invention is a two-stage cooling apparatus. It is an aim of the present invention to provide a cooling apparatus capable of effectively cooling fluid flowing to and from an internal combustion engine. It is another aim of the present invention to provide a cooling apparatus that can be easily installed.

Referring now to the figures of the present disclosure. The two-stage cooling apparatus of the present invention comprises an outer member 100 and an inner member 200.

The outer member 100 may be a first-stage cooling portion. It should be noted that the outer member 100 can be of any shape, size, material, features, type or kind, orientation, location, quantity, components, and arrangements of components that would allow the present invention to fulfill the objectives and intents of the present invention. In one embodiment, the outer member 100 has a first end 101 and a second end 102. The outer member 100 comprises a first end base 111, a second end base 112, a central hole 105, a plurality of heatsinks 120, and a plurality of longitudinal slots 130. The first end base 111 is located at the first end 101 of the outer member 100, while the second end base 112 is located at the second end 102 of the outer member 100. In one embodiment, the outer member 100 has a cylindrical shape. Accordingly, the first end base 111 and the second end base may each be in the form of an annular disk with an opening in the center. In one embodiment, the first end base 111 may comprise an outer flange 114, an inner flange 115, and a circumferential groove 116 formed by the outer flange 114 and the inner flange 115. Suitable sealing devices (e.g., an O-ring) may be seated in the circumferential groove 116 to prevent any leakage.

The plurality of heatsinks 120 is circumferentially arranged about the central hole 105. Each heatsink 120 extends from the first end base 111 to the second end base 112 of the outer member 112. In one embodiment, each heatsink 120 comprises an outer heatsink base 121 and an outer heat dissipation mechanism 126. The central hole 105 may be formed by the first end base 111, the second end base 112, and the plurality of heatsinks 120. The outer heatsink base comprises an outer fluid channel 122 having an inlet 123 and an outlet 124, and the outer heat dissipation mechanism 126 is associated with the outer fluid channel to assist in heat dissipation of the fluid flowing through the outer fluid channel 122. In a preferred embodiment, the outer heatsink base 121 is located adjacent to the central hole 105, while the outer heat dissipation mechanism 126 extends outward from the outer heatsink base 121. Preferably, the outer heat dissipation mechanism 126 comprises a plurality of fins. In one embodiment, the plurality of fins has an annular sector shape. In a preferred embodiment, the outer heatsink base 121 may have an annular sector shaped cross, such that, in combination with the outer heat dissipation mechanism, it defines an overall annular sector-shaped profile. The plurality of longitudinal slots is arranged between two adjacent outer heatsinks 120 to facilitate heat dissipation from the inner member 200.

The inner member 200 may be a second-stage cooling portion. It should be noted that the inner member 200 can be of any shape, size, material, features, type or kind, orientation, location, quantity, components, and arrangements of components that would allow the present invention to fulfill the objectives and intents of the present invention. In one embodiment, the inner member 200 has a first end 201 and a second end 202. The inner member 200 is adapted to be secured into the central hole 105. In a preferred embodiment, the inner member 200 is secured into the central hole 105 via welding. However, it should be noted that any other suitable means can be used to secure the inner member 200 into the central hole 105 of the outer member 100. Preferably, The inner member 200 has a cylindrical shape. In one embodiment, the first end 201 of the inner member 200 comprises a first attachment mechanism 203. In a preferred embodiment, the first attachment mechanism 203 comprises internal threads. In one embodiment, the second end 202 of the inner member 200 comprises a second attachment mechanism 204. In a preferred embodiment, the second attachment mechanism 204 comprises external threads.

The inner member 200 comprises an inner heatsink base 221 and an inner heat dissipation mechanism 226. The inner heatsink base 221 comprises an inner fluid channel 222 having an inlet 223 and an outlet 224. The inner heat dissipation mechanism 226 is associated with the inner fluid channel 222. In one embodiment, the inner heat dissipation mechanism 226 comprises a plurality of fins. The inner heat dissipation mechanism 226 may extend outward from the inner heatsink base 221. In the present invention, the inner heat dissipation mechanism 226 may dissipate heat to ambient air via the plurality of longitudinal slots 130, thereby cooling the fluid in the inner fluid channel 222.

In one embodiment, the inlet 123 of the outer fluid channel 122 is adapted to be in fluid communication with an internal combustion engine, and the outlet 124 of the outer fluid channel 122 is adapted to be in fluid communication with an oil filter. Further, the inlet 223 of the inner fluid channel 222 is adapted to be in fluid communication with the oil filter, and the outlet 224 of the inner fluid channel 222 is adapted to be in fluid communication with the internal combustion engine. In this way, the oil flows from the internal combustion engine to the oil filter via the plurality of outer fluid channels 122 and goes through a first-stage cooling process. After being filtered by the oil filter, the oil runs back to the internal combustion engine via the inner fluid channel 222 and completes a second-stage cooling process. The two-stage cooling process provided by the present invention can improve cooling efficiency and prevent the engine from overheating.

The present invention can also be conveniently installed. After the oil filter is removed, the first end of the present invention is connected to the engine via the first attachment mechanism 203, and then the oil filter is connected to the second end of the present invention via the second attachment mechanism 204.

The present invention may be made of any suitable material. Preferably, the present invention may be made of metals such as aluminum. It should be understood that the components of the present invention may or may not be made of the same material.

It is envisioned that the sizes of the components forming the present invention such as the outer member 100 and/or the inner member 200 can vary based on design requirements.

Although the disclosure has been explained in relation to its preferred embodiment, it is to be understood that many other possible modifications and variations can be made without departing from the spirit and scope of the disclosure.

What is claimed is:

1. A two-stage cooling apparatus comprising:
- an outer member having a first end and a second end and comprising:
  - a first end base located at the first end of the outer member;
  - a second end base located at the second end of the outer member;
  - a central hole;
  - a plurality of heatsinks that are circumferentially arranged about the central hole, each heatsink extending from the first end base to the second end base of the outer member and comprising:
  - an outer heatsink base comprising an outer fluid channel having an inlet and an outlet; and
  - an outer heat dissipation mechanism associated with the outer fluid channel; and
  - a plurality of longitudinal slots arranged between two adjacent heatsinks; and
  - an inner member having a first end and a second end, wherein the inner member is adapted to be secured into the central hole and comprises:
  - an inner heatsink base comprising an inner fluid channel having an inlet and an outlet; and
  - an inner heat dissipation mechanism associated with the inner fluid channel.

2. The two-stage cooling apparatus as claimed in claim 1, wherein the outer member has a cylindrical shape.

3. The two-stage cooling apparatus as claimed in claim 1, wherein the inlet of the outer fluid channel is adapted to be in fluid communication with an internal combustion engine, and the outlet of the outer fluid channel is adapted to be in fluid communication with an oil filter.

4. The two-stage cooling apparatus as claimed in claim 3, wherein the inlet of the inner fluid channel is adapted to be in fluid communication with the oil filter, and the outlet of the inner fluid channel is adapted to be in fluid communication with the internal combustion engine.

5. The two-stage cooling apparatus as claimed in claim 1, wherein the outer heatsink base is located adjacent to the central hole, while the outer heat dissipation mechanism extends outward from the outer heatsink base.

6. The two-stage cooling apparatus as claimed in claim 5, wherein the outer heat dissipation mechanism comprises a plurality of fins.

7. The two-stage cooling apparatus as claimed in claim 6, wherein the plurality of fins has an annular sector shape.

8. The two-stage cooling apparatus as claimed in claim 1, wherein the first end base comprises an outer flange, an inner flange, and a circumferential groove formed by the outer flange and the inner flange.

9. The two-stage cooling apparatus as claimed in claim 1, wherein the inner member is secured into the central hole via welding.

10. The two-stage cooling apparatus as claimed in claim 9, wherein the inner member has a cylindrical shape.

11. The two-stage cooling apparatus as claimed in claim 1, wherein the first end of the inner member comprises a first attachment mechanism.

12. The two-stage cooling apparatus as claimed in claim 11, wherein the first attachment mechanism comprises internal threads.

13. The two-stage cooling apparatus as claimed in claim 1, wherein the second end of the inner member comprises a second attachment mechanism.

14. The two-stage cooling apparatus as claimed in claim 13, wherein the second attachment mechanism comprises external threads.

15. The two-stage cooling apparatus as claimed in claim 1, wherein the inner heat dissipation mechanism extends outward from the inner heatsink base.

16. The two-stage cooling apparatus as claimed in claim 15, wherein the inner heat dissipation mechanism comprises a plurality of fins.

* * * * *